United States Patent [19]

Wright et al.

[11] Patent Number: 4,773,596

[45] Date of Patent: Sep. 27, 1988

[54] AIRBLAST FUEL INJECTOR

[75] Inventors: Richard R. Wright, Willimantic; Francis C. Pane, Jr., South Windsor; John A. Matthews, Melrose; Edmund E. Striebel, South Windsor, all of Conn.

[73] Assignee: United Technologies Corporation, Hartford, Conn.

[21] Appl. No.: 34,366

[22] Filed: Apr. 6, 1987

[51] Int. Cl.[4] ..... B05B 15/00

[52] U.S. Cl. ..... 239/400; 239/403; 239/406; 239/419.5; 239/424.5

[58] Field of Search ..... 239/290, 291, 400, 403, 239/422, 424, 424.5, 423, 404–406, 419, 419.5; 60/740–742

[56] References Cited

U.S. PATENT DOCUMENTS

| | | | |
|---|---|---|---|
| 1,451,063 | 4/1923 | Anthony | 239/405 X |
| 3,657,885 | 4/1972 | Bader | 60/742 X |
| 3,768,250 | 10/1973 | Kawaguchi | 239/424.5 X |
| 4,362,022 | 12/1982 | Faucher et al. | 60/742 |
| 4,418,543 | 12/1983 | Faucher et al. | 60/742 |
| 4,595,143 | 6/1986 | Simmons et al. | 239/406 |
| 4,609,150 | 9/1986 | Pane, Jr. et al. | 239/400 X |
| 4,616,784 | 10/1986 | Simmons et al. | 239/404 |

FOREIGN PATENT DOCUMENTS

| | | | |
|---|---|---|---|
| 132213 | 1/1985 | European Pat. Off. | 60/740 |

*Primary Examiner*—Andres Kashnikow
*Assistant Examiner*—Mary Beth O. Jones
*Attorney, Agent, or Firm*—Edward L. Kochey, Jr.

[57] ABSTRACT

A fuel injector assembly for a gas turbine combustor projects a hollow conical spray of fuel. A plurality of discrete surrounding air nozzles 42 project air directly toward the axis 46 of the injector at an angle of 15 degrees, establishing a fuel rich external recirculation zone 52.

5 Claims, 2 Drawing Sheets

FIG. 2
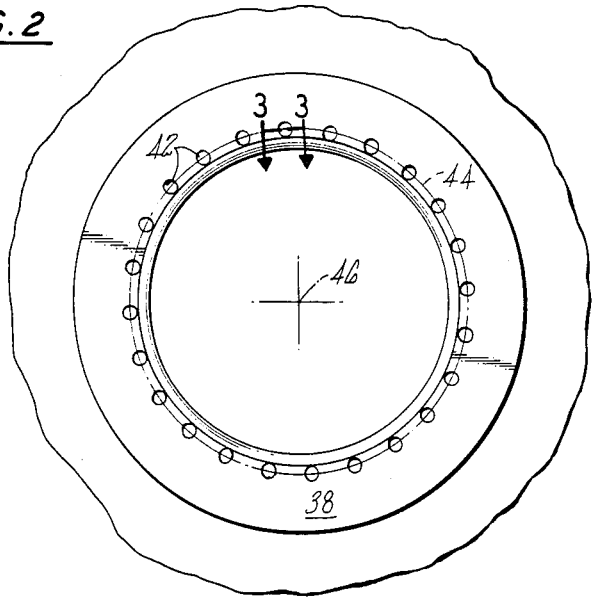
FIG. 3
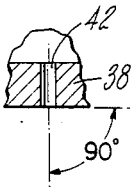
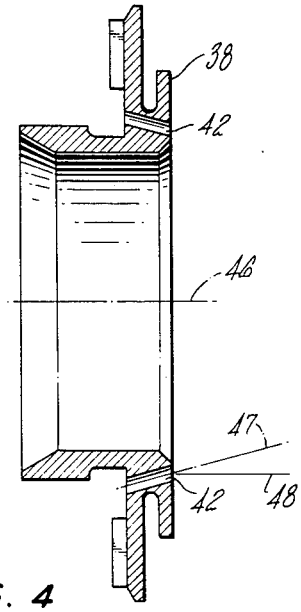
FIG. 4

AIRBLAST FUEL INJECTOR

DESCRIPTION

1. Technical Field

The invention relates to injectors for spraying fuel into gas turbine combustion chambers and in particular to an improvement in the stability of airblast type nozzle assemblies.

2. Background Art

Combustion chambers of gas turbines conventionally include a metal shell or liner which defines a volume of high velocity and turbulent gases in which combustion takes place. It is of utmost importance that a recirculation zone be formed that lowers the effective velocity to or below the burning velocity. This stabilization zone provides an ignition and pilot source for the entire combustion chamber.

Airblast type injectors conventionally use a conical spray pattern of fuel with an inner air supply within the cone as a portion of the combustion supporting air. Additional air is introduced in a swirling pattern interacting with the conical spray to supply additional combustion supporting air and to induce turbulance. Still additional air has been introduced at a further outboard location, with this air also being introduced generally tangentially to the conical spray. This airflow has not only supplied additional combustion supporting air but has induced the recirculation zone outside the conical spray with a tendency to maintain the stability of the flame.

We have found, however, that while a recirculation zone is established, this recirculation zone is predominantly air with very little fuel induced into the zone. Accordingly, the recirculation zone tends to be fuel lean and therefore is not the optimum mix for maintaining flame stability.

DISCLOSURE OF THE INVENTION

A fuel injector of the airblast type has a substantially hollow conical spray of fuel and air which is inherently concentric with an axis of the fuel injector. A plurality of discrete air nozzles introducing air are aimed directly toward the axis of the fuel injector. These nozzles are oriented at an angle between 12 and 25 degrees from a line parallel to the axis of the fuel nozzle. They are discrete nozzles occupying not more than 60 percent of the circumferential zone which they occupy and are preferably located within one inch of the axis.

The air nozzles with this orientation have sufficient penetration to induce substantial fuel into the recirculation zone while not driving through the cone so as to lose the recirculation zone.

BRIEF DESCRIPTION OF THE DRAWINGS

FIG. 2 is a detail of the guide ring carrying the surrounding air nozzles.

FIG. 3 is a sectional view through FIG. 2 showing the orientation of the nozzle in line with the axis.

FIG. 4 is a sectional view through the guide plate showing the orientation of the nozzle toward the axis.

BEST MODE FOR CARRYING OUT THE INVENTION

Figure 1:
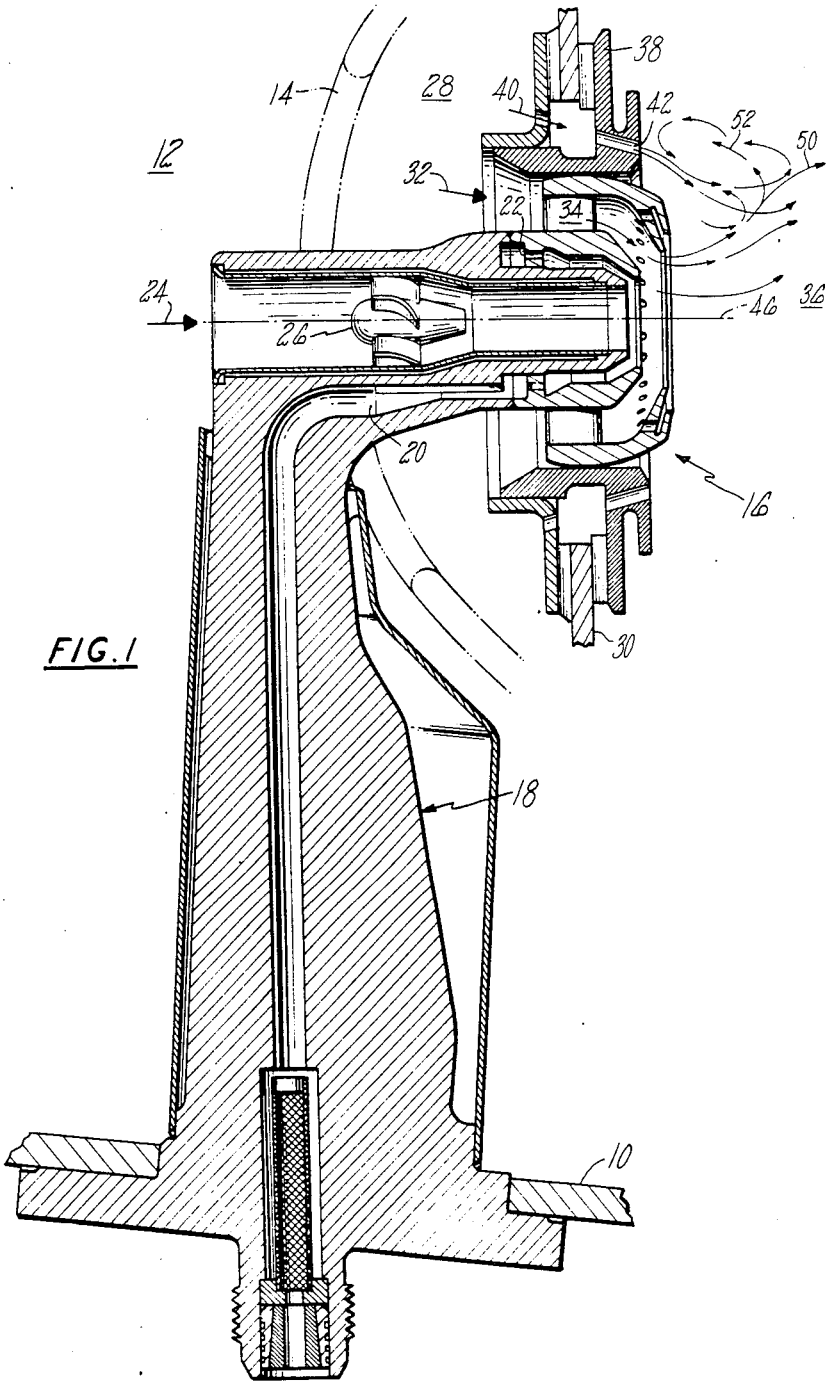
FIG. 1 is a general arrangement of the fuel injector assembly.

Illustrated in the general arrangement of FIG. 1 is casing 10 which surrounds an air plenum 12 confining an airflow. Within this casing is a combustion chamber liner 14 with fuel injector 16 mounted on strut 18 so as to be located within the combustion chamber liner. Fuel passes through supply passage 20 discharging through an annular space at the outlet of fuel injector 16. The fuel is nominally swirled by means of skewed passages 22 thereby distributing the fuel evenly around the circumference of the fuel injector 16.

An inner airflow 24 passes inside the fuel injector and may be swirled by swirler vanes 26 if desired. Combustion chamber liner 14 has openings therein and forms another air plenum 28 between the combustion liner and bulkhead 30. Outer air 32 passes through swirling vanes 34 from the plenum 28 into the combustion chamber 36. The interaction of the inner air 24 and the outer air 32 with the fuel produces a hollow conical discharge of fuel and air of an included angle of 60 to 70 degrees into the combustion chamber.

A sliding guide plate 38 supports the fuel injector with respect to bulkhead 30, thereby allowing for relative expansion between the strut 18 and the support of the combustion liner 14. Additional airflow 40 passes through this guide plate by means of discrete air nozzles 42.

The details of discrete nozzles 42 are best seen with reference to FIGS. 2, 3 and 4. Each nozzle 42 is 0.105 inches in diameter and 24 of these are arranged around a circle 44 which is 1.6 inches in diameter with respect to the circumference of circle 42 it can be seen that the total openings of nozzles 42 amounts to approximately 50 percent of the circumference. Accordingly, a plurality of discrete jets of air are passed through nozzles 42 toward the conical flow pattern within the combustion chamber.

These nozzles are aimed directly at the axis 46 of the fuel injector and as seen in FIG. 4 they are directed 47 at an angle of 15 degrees with respect to a line 48 parallel to axis 46.

The total of the inner airflow 24 plus the outer air 32 amounts to about 7 percent of the total airflow to the combustor. Additional airflow 40 amounts to 2 to 4 percent of the total airflow. This condition where the additional airflow 40 amounts to between 25 and 60 percent of the total inner plus outer airflow, provides sufficient relative momentum to achieve a stable fuel laden recirculation zone.

The airflow 40 interacts with the main combustion flow pattern 50 forming recirculation zones 52. In accordance with prior art teaching air similar to that in 40 has been introduced toward the conical pattern 50 but in a direction generally tangent to the pattern. While this has created some recirculation zone it is found that this zone is fuel lean. We have further found that even with introduction of the air 40 toward the axis 46 of the fuel nozzle insufficient recirculation has been obtained with angles less than 12 degrees with respect to a line parallel to the axis of the fuel injector. On the other hand, should the angle with respect to the fuel injector become too steep it is believed that this airflow penetrates through the cone thereby not achieving an effective recirculation zone. Accordingly it is found that by directing nozzle 42 directly towards the axis 46 but with an angle between 12 and 25 degrees from a line parallel to the axis appropriate penetration of the cone 50 is achieved to induce a substantial amount of fuel in recirculation zone 52. This provides a stability of operation that has not been achieved by the prior art systems.

We claim:

1. A fuel injector assembly for a gas turbine combustor comprising:

a fuel injector means for projecting a substantially hollow conical spray of fuel and air, concentric with an axis of said fuel injector;

means for introducing inner air centrally within said hollow conical spray;

means for introducing outer air outside said conical pattern in a direction substantially tangent to said hollow conical spray; and a plurality of discrete surrounding air nozzles, surrounding said fuel injector means and said means for introducing outer air, and directing additional air directly toward the axis of said fuel injector means.

2. A fuel injector assembly as in claim 1, said plurality of discrete surrounding air nozzles comprising:

a plurality of nozzles circumferentially arranged around said axis directing said additional air at an angle between 12 and 25 degrees from a line parallel to said axis.

3. A fuel injector assembly as in claim 2:

said additional airflow being 25 to 60 percent of the total quantity of said inner and outer airflows.

4. A fuel injector assembly as in claim 1:

said discrete surrounding air nozzles spaced in a circle and having at least 40 percent of the circle nozzle free.

5. A fuel injector assembly as in claim 1:

said plurality of discrete surrounding air nozzles being located within one inch of the axis of said fuel injector.

* * * * *